US011154928B2

(12) United States Patent
Johansen et al.

(10) Patent No.: US 11,154,928 B2
(45) Date of Patent: Oct. 26, 2021

(54) METHOD AND SYSTEM FOR INDEXING MOULDS

(71) Applicant: DISA Industries A/S, Taastrup (DK)

(72) Inventors: Jørn Erhard Johansen, Ølstykke (DK); Per Larsen, Søborg (DK)

(73) Assignee: DISA INDUSTRIES A/S, Taastrup (DK)

( * ) Notice: Subject to any disclaimer, the term of this patent is extended or adjusted under 35 U.S.C. 154(b) by 504 days.

(21) Appl. No.: 15/558,758

(22) PCT Filed: Apr. 17, 2015

(86) PCT No.: PCT/IB2015/052823
§ 371 (c)(1),
(2) Date: Sep. 15, 2017

(87) PCT Pub. No.: WO2016/166579
PCT Pub. Date: Oct. 20, 2016

(65) Prior Publication Data

US 2018/0065176 A1 Mar. 8, 2018

(51) Int. Cl.
*B22D 33/00* (2006.01)
*B22C 11/10* (2006.01)
*B22D 47/02* (2006.01)

(52) U.S. Cl.
CPC ..... *B22D 33/005* (2013.01); *B22C 11/10* (2013.01); *B22D 47/02* (2013.01)

(58) Field of Classification Search
CPC ..... B22C 11/00; B22C 11/10; B22D 33/005
See application file for complete search history.

(56) References Cited

U.S. PATENT DOCUMENTS 3,744,552 A * 7/1973 Lundsgart ..... B22D 33/005 164/187
3,749,151 A 7/1973 George et al.
(Continued)

FOREIGN PATENT DOCUMENTS

DE 1 783 120 8/1971
WO 0 693 337 A1 1/1996
(Continued)

OTHER PUBLICATIONS

Machine Translation of EP0693337 A1 (published Jan. 24, 1996, cited in IDS filed Sep. 15, 2017). (Year: 1996).*

*Primary Examiner* — Kevin E Yoon
*Assistant Examiner* — Jacky Yuen
(74) *Attorney, Agent, or Firm* — Birch, Stewart, Kolasch & Birch, LLP

(57) ABSTRACT

A method and system for indexing moulds using a flaskless moulding machine and a mould conveyor are provided. The method comprises: (i) forming one or more moulds, each of the one or more moulds being added to the mould string while the mould string is stationary by being brought into contact with the mould string. Once the one or more moulds has been added to the mould string, the method continues (ii) by advancing the mould string, in a single continuous motion, a distance corresponding to the sum of the thicknesses of the one or more moulds, wherein (1) the moulding machine assists the mould conveyor in advancing the mould string during a first part of the distance, and (2) the mould conveyor advances the mould string a second part of the distance, corresponding to the remainder of the distance, without assistance from the moulding machine.

11 Claims, 5 Drawing Sheets

(56) References Cited

U.S. PATENT DOCUMENTS

Figure 1A:
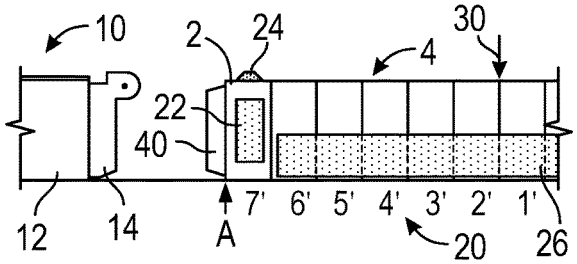

| | | | | |
|---|---|---|---|---|
| 4,765,389 | A * | 8/1988 | Knudsen | B22C 9/108 164/137 |
| 2008/0135205 | A1 | 6/2008 | Jezwinski | |
| 2014/0110075 | A1 * | 4/2014 | Paalanen | B22C 9/084 164/23 |
| 2016/0184882 | A1 * | 6/2016 | Calvo Poza | B22C 19/00 164/18 |

FOREIGN PATENT DOCUMENTS

| | | | | |
|---|---|---|---|---|
| WO | WO 02/26427 | A1 | 4/2002 | |
| WO | WO-0226427 | A1 * | 4/2002 | B22C 11/10 |

* cited by examiner

METHOD AND SYSTEM FOR INDEXING MOULDS

The present invention concerns a method and system for indexing moulds whereby the production rate of moulds may be increased in a robust way.

Operators of metal foundries have always been interested in increasing the production rate of castings. Accordingly manufacturers of equipment for metal foundries have devised improvements to the machines used in the metal foundries. For green sand metal foundries operating flaskless moulding machines, in which each mould produced is added to a string of moulds, these improvements have included improvements to the moulding machines, improvements to the mould conveyors carrying the mould string, and improvements to the pouring machines used to pour the molten metal into the mould cavities produced in the moulds.

The general principle of the flaskless moulding machine is described in U.S. Pat. No. 3,008,199A (DISA), in which the original DISAMATIC® process is disclosed. This process is performed using a flaskless moulding machine comprising a pressure plate driven by a pressure piston, a swing plate, and a mould conveyor comprising a transport system for transporting a mould string produced from moulds produced by the flaskless moulding machine. The process involves the steps of A) producing a mould by pressing a mould between pattern plates attached to the pressure plate and the swing plate, respectively, using the moulding machine, B) adding the mould to the mould string using the pressure plate, and C) advancing the mould string the thickness of one mould using the pressure plate, i.e. indexing the moulds in the mould string, in later versions assisted by the transport system. No new mould can be produced during the time that the pressure plate is involved in indexing the moulds in the mould string. Accordingly it is only after the mould string has been indexed and the pressure plate has returned to its ready position that a new mould can be produced. This limits the production rate.

One attempt at improving the production rate of the flaskless moulding machine described above involves decreasing the travel of the pressure plate, this technique is applied in the DISAMATIC® 2100. In this technique each mould produced by the flaskless moulding machine is ejected from the moulding machine and added to the mould string at a position in which the mould intersects the movement path of the swing plate. The advancement of the mould string is then performed solely by the transport system simultaneously with the pressure plate retracting and the swing plate starting to move towards the position for producing a new mould. The decreased travel of the pressure plate results in an increased production rate as the cycle time of the flaskless moulding machine decreases.

Another attempt of increasing production rate is disclosed in EP1402976. In this process a mould produced by the flaskless moulding machine is deposited and added to the mould string at an intermediate station outside the path of the swing plate, whereafter the mould string is advanced using the transport system. This increases the production rate as the cycle time of the flaskless moulding machine decreases, but less than achieved by the DISAMATIC® 2100 as the travel of the pressure piston is shorter in the DISAMATIC® 2100.

With methods and processes as exemplified above, the production rate of moulds may be increased. However, the time needed for solidification of the molten metal that is poured into the moulds, i.e. the in-mould cooling time, generally remains the same. As the moulds in the mould string cannot be broken open to remove the casting until the casting has solidified and cooled sufficiently, the number of moulds in the mould string increases with increased production rate. As the number of moulds in the mould string increases the weight of the mould string increases. This in turn means that more power and force is required to index the moulds in the mould string. For the above exemplified methods and processes, the capabilities of the mould conveyor, to index the mould string, may now become a limiting factor for the production rate due to the increased weight of the mould string. This may require new stronger mould conveyors which makes the methods difficult to implement with existing equipment. It may also be difficult to devise sufficiently strong transport systems which at the same time have the high precision needed so that the moulds in the mould string do not become misaligned during the indexing. Additionally the large forces needed for indexing the mould string have to be transferred to the mould string, and, if this is done by clamping moulds laterally, the forces may damage the moulds due to the high clamping pressure needed. Finally, there may be a risk of mould openings, i.e. where individual moulds in the mould string become partially or fully separated from each other, during the indexing of the mould string.

Accordingly, in summary of the prior art and the therewith associated drawbacks, there still exists a need for an improved technique or process which achieves a high production rate, yet addresses the problem with the increasing weight of the mould string associated with a high production rate.

It is accordingly an object of the present invention to provide a method and system of indexing moulds in a mould string which results in a high production rate while being capable of managing the weight of the mould string.

It is further an object of the present invention to provide a method and system of indexing moulds in a mould string which are producing castings more cost efficient.

It is further an object of the present invention to provide a method and system of indexing moulds in a mould string which do not require extensive modifications to existing equipment.

At least one of the above objects, or at least one of any of the further objects which will be evident from the below description, is according to corresponding first and second aspects of the present invention achieved by the method according to the claims and the system according to the claims.

As the flaskless moulding machine assists the mould conveyor in advancing the mould string the first part of the distance the mould conveyor does not have to be as strong. This may make it possible to use the method also with existing mould conveyors. Further, the flaskless moulding machine typically has a high precision thus helping the mould conveyor in maintaining the precision and alignment of the moulds in the mould string during the advancement.

On the other hand, as the mould conveyor advances the mould string the second part of the distance without the assistance of the flaskless moulding machine, the flaskless moulding machine is free to start preparing and producing a new mould during this time. This increases the production rate.

Thus, in summary, the method and system according to the corresponding first and second aspects of the present invention strike an advantageous balance between the technology of U.S. Pat. No. 3,008,199A and the later DISAMATIC® 2100 technology. As will be shown in the various advantageous embodiments of the method and system according to the first and second corresponding aspects of the present invention described herein, a significant proportion of the increased production capacity of the DISA-MATIC® 2100 technology can be achieved with less strong mould conveyors, and with less risk of getting dimensional and other problems with the castings.

The method and system according to the corresponding first and second aspects of the present invention are further not limited to single-indexing of moulds, instead they can be used with double-indexing, triple-indexing, etc. of the mould string. When double-indexing or triple-indexing, etc., is combined with double-pouring or triple-pouring, etc., as described in a co-pending patent application of the present applicant, the method and system according to the corresponding first and second aspects of the present invention further provide a long available pouring time which allows the flowrate (kg/s) of molten metal to be kept low during pouring. This lowers the risk of risk of turbulence and erosion, which may lead to defective castings due to erosion of the mould cavity by the molten metal.

In particular the method and system according to the corresponding first and second aspects of the present invention may allow the implementation of the method and systems described in the abovementioned co-pending application, and described herein, using existing equipment or with less strong mould conveyors.

The one or more moulds is typically one or two moulds, but can be larger such as 3 or more moulds. Where the one or more moulds are two, the moulds are double-indexed, i.e. moved forward the distance equal to two mould thicknesses in one movement. Where the one or more moulds are three, the moulds are triple-indexed and so on.

The moulds are preferably made from green sand. Each mould comprises a first mould face and a second mould face defining a first partial mould cavity and a second partial mould cavity such that when positioned one after the other in a mould string, the first partial mould cavity and the second partial mould cavity together define the mould cavity. The mould string comprises a plurality of moulds. The moulds in the mould string are preferably identical; however the mould string may contain groups of different moulds if the pattern plates are changed during production.

The flaskless moulding machine produces moulds by squeezing a mouldable material, preferably green sand, between pattern plates corresponding to the first and second partial mould cavities. Preferably the flaskless moulding machine is a flaskless vertical green sand moulding machine in which the pattern plates are generally vertical for producing moulds which are positionable one after the other in a horizontal direction such that the mould cavities are produced at the vertical parting line between the individual moulds.

The pattern plates of the flaskless moulding machine are mounted on squeeze plates. One of the squeeze plates is driven by a pressure piston for squeezing the mouldable material. The other of the squeeze plates is stationary during squeezing, or alternatively assists in squeezing, and is then moved out of the way, preferably by a rotating movement, for allowing the pressure piston to push the produced mould out of the moulding machine. The pressure piston may be hydraulic or electrical. Likewise the other of the squeeze plates may be hydraulically or electrically driven.

The flaskless moulding machine may be configured to form one or more moulds by being connected to a control circuit causing the flaskless moulding machine to cyclically perform the operations of: introducing mouldable material in the moulding chamber of the flaskless moulding machine, squeezing the mouldable material to form the mould, opening the moulding chamber by retracting and swinging one of the pattern plates, i.e. the swingable squeeze plate, ejecting the mould from the moulding chamber using the pressure piston, moving to close up with the mould string, i.e. adding the mould to the mould string, retracting the pressure piston, and closing the moulding chamber by moving and swinging down the swingable squeeze plate.

The mould cavities may comprise, or be fluidly connected to, a pouring cup for receiving the molten metal from the pouring station. This is typically done from the top.

Adding a mould to the mould string may comprise pushing the mould against the last mould in the mould string at a certain contact pressure suitable to ensure that the moulds do not separate when molten metal is poured into the mould cavity between them, causing dimension errors on the casting, leading to scrap, and on the other hand is not so big that it causes the moulds to deform. Each mould in the mould string is in contact with two adjacent moulds, except the last mould closest to the flaskless moulding machine.

The mould conveyor may be an AMC (Automatic Mould Conveyor) or a PMC (Precision Mould Conveyor) and includes devices such as thrust bars or walking bars for advancing the mould string, which are known to the person skilled within the art of moulding machines, or any other system suitable for transporting, i.e. advancing, the mould string.

The method and system according to the corresponding first and second aspects of the present invention may further comprise pouring, preferably simultaneously, a first number of moulds in the mould string, the first number of moulds comprising the same number of moulds as the one or more moulds, during the time that the mould string is stationary, i.e. during the time that a new set of one or more moulds are produced and added to the mould string. Pouring commences after the mould string has been advanced, and ceases once the last of the new set of one or more moulds has been added to the mould string.

The pouring may be performed by one or more first pouring units, one for each of the one or more moulds, or alternatively, by one or more second pouring units, each of the second pouring units being configured to simultaneously pour two or more of the one or more moulds.

As the pouring of the first number of moulds takes place during the time that the mould string is stationary, which is the time needed for producing the one or more moulds and adding them to the mould string, the time available for pouring will be longer if two or more moulds are produced and added to the mould string compared to when only one mould is produced and added to the mould string. As long as the pouring of the first number of moulds is simultaneous the flow rate kg/s of molten metal may be lowered because the time available for pouring the moulds has increased. This lowers the risk of turbulence and erosion which may lead to defective castings due to loose sand from the erosion of the mould cavity by the molten metal.

The first part of the distance is the initial part or portion of the total distance the mould string has to be advanced. In other words the total distance may be divided into a first part and a second part, where the first part is from the position that the mould string is in when it is stationary, i.e. before it is advanced, to a position dividing the first part from the second part, and the second part of the distance is from this position to the position that the mould string is in when it is once more stationary after having been advanced the distance, corresponding to the remainder of the distance.

The flaskless moulding machine may assist the mould conveyor in advancing the mould string the first part of the distance by providing all, or more preferably a part of the force needed to advance the mould string the first distance, the remainder of the force needed being provided by the mould conveyor.

In the context of the present invention: "without assistance from the flaskless moulding machine" encompasses that the mould conveyor provides all the force needed for advancing the mould string the second part of the distance.

The single motion is continuous.

The embodiments of the method and the system according to the corresponding first and second aspects of the present invention defined in one or more of the claims specify that it is the pressure piston of the flaskless moulding machine which is responsible for assisting the mould conveyor in advancing the mould string the first part of the distance.

The pressure piston assists the mould conveyor by pushing on the last mould, of the one or more moulds, that was produced and added to the mould string. In cases where the mould conveyor clamps moulds in the mould string laterally, the assistance provided by the pressure piston allows the clamping pressure to be lowered, thus decreasing the risk of damaging the moulds. The assistance provided by the mould string also reduces the risk of mould openings during the indexing of the mould string.

Once the pressure piston has assisted the mould conveyor in advancing the mould string the first part of the distance it may be retracted into the flaskless moulding machine for producing a new mould. As the pressure piston only needs to travel the first part of the distance, and not the full distance, the travel of the pressure piston is reduced, and the cycle time of the flaskless moulding machine is similarly reduced, leading to an increased production rate in relation to if the pressure piston had to travel the full distance.

Generally a pressure plate is attached to the pressure piston, and it is this pressure plate which, by being moved by the pressure piston, contacts the last mould of the one or more moulds during the advancing of the mould string the first part of the distance.

The embodiments of the method and the system according to the corresponding first and second aspects of the present invention defined in one or more of the claims specify a wide range of possible first parts of the distance. Generally, to optimize production rate the first part of the distance should be short, i.e. down to about 1% of the distance, so as to limit the travel of the pressure piston, and thereby limit the cycle time of the flaskless moulding machine and at the same time obtaining the advantage of overcoming static friction. With such short a first part of the distance the assistance provided to the mould conveyor by the flaskless moulding machine is however very limited. On the other hand, great assistance to the mould conveyor can be provided if the flaskless moulding machine assists the mould conveyor during the advancing of the mould string a first part approximating the full distance, i.e. up to about 99% of the distance. However, in this case the travel of the pressure piston will not be significantly decreased so that only a small increase in production rate will be achieved.

The embodiments of the method and the system according to the corresponding first and second aspects of the present invention defined in one or more of the claims are advantageous as they provide the highest production rate by providing the shortest travel of the pressure piston. Further these embodiments help prevent mould openings between the last mould and the next to last mould in the mould string, especially mould openings generate at the start of the mould string transport/advancement.

Generally the advancing of the mould string the distance comprises the steps of:

a) overcoming the static friction to movement of the mould string, i.e. bringing the mould string in motion, b) overcoming the dynamic friction and inertia forces to accelerate the mould string to a desired speed, c) maintaining the speed of the mould string at the desired speed, i.e. overcoming the dynamic friction, and d) reducing the speed in a controlled way to end the movement of the mould string when it has been moved the distance.

Of these steps, step (a) of overcoming the static friction requires a larger force yet does not involve much travel of the mould string. Thus, when the flaskless moulding machine assists the mould conveyor in overcoming static friction between the mould string and the mould conveyor, then the mould conveyor is relieved of having to overcome all or parts of the static friction.

In these embodiments the first part of the distance may comprise the distance traveled by the mould string as it is brought in motion. The first distance may for example be about 1 to about 5% of the distance.

The static friction and the dynamic friction may be between the mould string and the mould conveyor in case the mould conveyor is an AMC, or in the mechanical parts in the mould conveyor that are involved in advancing the mould string, for example the bearings and joints of a walking bar system in a PMC.

The embodiments of the method and the system according to the corresponding first and second aspects of the present invention defined in one or more of the claims are advantageous as they provide a high production rate while providing good assistance to the mould conveyor.

In addition to step (a) of overcoming the static friction between the mould string and the mould conveyor for bringing the mould string in motion, step (b) of accelerating the mould string to the desired speed also requires larger force. Thus by having the flaskless moulding machine assist the mould conveyor in first overcoming the static friction, for bringing the mould string in motion, and then overcoming dynamic friction and inertia forces for accelerating the mould string, the strength of the mould conveyor may be decreased significantly.

The desired speed is also called the transport speed.

In these embodiments the first part of the distance may further comprise the distance traveled by the mould string as it accelerated to the desired speed. The first distance may for example be up to 50% of the distance.

The embodiments of the method and the system according to the corresponding first and second aspects of the present invention defined in one or more of the claims provide even more assistance to the mould conveyor at the cost of some further production rate.

Generally the force and power required for step 3, i.e. overcoming the dynamic friction between the mould string and the mould conveyor, is such that it can be capably handled by the mould conveyor on its own, however, these embodiments may be advantageous for further preventing mould openings during the advancing of the mould string. Further, these embodiments may also be advantageous if it is desired to transport the mould string at a speed above that which the mould conveyor can provide on its own. Once the mould string has been advanced to the position the flaskless moulding machine may disengage the mould string.

In these embodiments the first part of the distance may further comprise the distance traveled by the mould string as it is advanced to the position. The first part may typically be above 50% of the distance.

The embodiments of the method and the system according to the corresponding first and second aspects of the present invention defined in one or more of the claims specify that the pressure piston is retracted once the mould string has been advanced the first part of the distance.

The pressure piston is typically retracted into a ready position in the moulding chamber of the flaskless moulding machine.

The embodiments of the method and the system according to the corresponding first and second aspects of the present invention defined in one or more of the claims are advantageous as they provide a simple way of adding each of the one or more moulds to the mould string.

The pressure piston is used to first push each of one or more moulds out of the moulding machine, and then to push each mould the distance between the flaskless moulding machine and the mould string for bringing each mould into contact with the mould string. Further, as the pressure piston pushes each mould, using the squeeze plate with one of the pattern plates used for producing the mould, a large contact area with each mould is available, thereby lessening the stress on each mould during transport from the flaskless moulding machine to the mould string.

The embodiments of the method and the system according to the corresponding first and second aspects of the present invention defined in one or more of the claims are advantageous as they further decrease the cycle time of the flaskless moulding machine and thereby increases the production rate. This is due to the pressure piston having to travel less. The cycle time is further decreased because, in the case when the pressure piston of the flaskless moulding machine brings a mould of the one or more moulds into contact with the mould string, it may be necessary to decrease the speed of the pressure piston, at least when the mould is close to the mould string and when/if establishing a contact pressure between the mould and the mould string, so as not to damage the mould or the mould string due to shock. In contrast, the mould conveyor may have a speed, or have a varying speed, as required to prevent such damage without influencing the cycle time of the flaskless moulding machine.

The remainder of the one or more moulds are moved to the intermediate position by being pushed by the pressure piston of the moulding machine.

The intermediate position is a position in which each of the remainder of the one or more moulds is spaced apart from the flaskless moulding machine and the mould string. Preferably, the first intermediate position is as close as possible to the flaskless moulding machine, e.g. beneath the swingable squeeze plate of the flaskless moulding machine.

To optimize the speed of the moulding machine the intermediate position where the pressure piston delivers the mould, and in which position the mould conveyor takes over the transport of the mould, is the best compromise between:

i) The pressure piston has to deliver the mould as close to the flaskless moulding machine as possible to reduce the travel needed by the pressure piston, ii) The pressure piston has to partly move back into the moulding chamber of the flaskless moulding machine before the swingable squeeze plate can swing down, and iii) The mould has to be moved away from below the swingable squeeze plate, i.e. the "swing plate", by the mould conveyor before the swingable squeeze plate can swing down. If the intermediate position is too close to the flaskless moulding machine the cycle has to wait for the mould conveyor to move the mould away from below the swingable squeeze plate before it can swing down. If the intermediate position is too far away from the flaskless moulding machine the cycle has to wait for the pressure piston to move away from below the swingable squeeze plate before it can swing down. Accordingly the optimum intermediate position is a position where the mould conveyor moves the mould out making it possible to swing the swingable squeeze plate down at the same time as the pressure piston has moved back enough to also make it possible to swing the swingable squeeze plate down.

The mould conveyor may comprise moveable mould retainers for clamping the at least one mould laterally, or top and bottom, and for moving the at least one mould.

In order for the flaskless moulding machine being able to assist the mould conveyor in advancing the mould string the first part of the distance the last mould of the one or more moulds should be added to the mould string by the flaskless moulding machine.

The speed at which the each of the remainder of the one or more moulds is moved from the intermediate position into contact with the mould string by the mould conveyor may follow a speed profile with an initial high speed followed by a lower speed from a position close to the mould string until the mould has been added to the mould string.

The embodiments of the method according to the first aspect of the present invention as defined in one or more of the claims define the setting of cores.

The core setter is required to be able to set cores at the one or more positions as the mould string grows towards the flaskless moulding machine as each of the one or more moulds is added to the mould string.

As each mould after being added to the mould string is kept in a more stable position due to being brought into contact with the mould string, the cores can be set with higher precision. Further when setting the cores in the first of the one or more moulds, the core setter interferes less with the operations of the flaskless mould machine. Therefore the movement of the core setter may be better optimised to decrease cycle time.

A core is basically used to be able to produce castings with internal cavities. Further it can serve other purposes for instance being used when the casting has external undercuts which cannot be moulded.

In the context of the present invention, an open mould cavity corresponds to a partial mould cavity.

Cores must be inserted before the next mould of the one or more moulds is added to the mould string.

The embodiments of the method according to the first aspect of the present invention as defined in one or more of the claims are advantageous as they only require a core setter capable of setting cores in a single position. Preferably the core setting position is positioned further away from the flaskless moulding machine to reduce the time that the core setter interferes with the operation of the flaskless moulding machine. The moveable mould retainers, which moved the mould from the intermediate position to the core setting position, move the mould to add it to the mould string after the core(s) has been set. The core setting position and the intermediate position may be the same, although not if optimal production speed is desired.

The embodiments of the method and the system according to the corresponding first and second aspects of the present invention defined in one or more of the claims define a suitable configuration of the mould conveyor for advancing the mould string. The transport system may be an AMC-PMC combo as shown in US20050211409, a PMC system (walking bars) alone, or an AMC system (thrust bars) alone, or any other suitable transport system. When the transport system is an AMC system, the transport system may comprises two opposed thrust bars or plates which engage the mould string laterally and which pulls the mould string forward for advancing it. When the transport system is a PMC system, it may comprise walking bars which engage the bottom of the moulds for suspending and moving the mould string forward. The moveable mould retainers may comprise two opposed clamping plates for laterally clamping the single mould.

The second plurality of moulds is generally a larger number than the one or more moulds and may include all the moulds in the mould string.

The embodiments of the method and the system according to the corresponding first and second aspects of the present invention defined in one or more of the claims are advantageous as they assist in keeping the mould string stationary while producing and adding the first plurality of moulds.

The retaining device may comprise a clamp, electrically, hydraulically or pneumatically actuated, which engages the top/bottom or the sides of the last mould.

The retaining device selectively keeps the mould string stationary by being actuable to either engage the last mould, or release the last mould.

In addition to the last mould the retaining device may engage further moulds of the mould string. Further the method and the system according to the corresponding first and second aspects of the present invention may involve a plurality of stationary mould retainers for engaging each of the one or more moulds after each mould has been added to the mould string.

The invention and its many advantages will be described in more detail below with reference to the accompanying schematic drawings, which for the purpose of illustration show some non-limiting embodiments, and in which:

FIG. 1 shows a sequence of operations of the flaskless moulding machine, the mould conveyor, and the pouring unit in a first embodiment of the method according to the first aspect of the present invention;

FIG. 2 shows a sequence of operations of the flaskless moulding machine, the mould conveyor, and the pouring unit in a second embodiment of the method according to the first aspect of the present invention; and FIG. 3 shows a sequence of operations of the flaskless moulding machine, the mould conveyor, and the pouring unit in a third embodiment of the method according to the first aspect of the present invention.

In the below description, one or more 'signs added to a reference number indicates that the element referred to has the same or similar function as the element designated the reference number without the 'sign, however, differing in structure.

Additionally, where useful for discussing two or more identical elements, a subscript Arabic numeral is used to designate such further identical elements.

When further embodiments of the invention are shown in the figures, the elements which are new in relation to earlier shown embodiments have new reference numbers, while elements previously shown are referenced as stated above. Elements which are identical in the different embodiments have been given the same reference numerals, and no further explanations of these elements will be given.

FIG. 1 shows a sequence of operations of a flaskless moulding machine, in its entirety designated the reference numeral 10, moulds, one of which is the last mould and is designated the reference numeral 2, in a mould string 4 on a mould conveyor, in its entirety designated the reference numeral 20, and a pouring unit indicated by arrow 30 in a first embodiment of the method according to the first aspect of the present invention. In this first embodiment the one or more moulds is a single mould.

The flaskless moulding machine 10 comprises a moulding chamber 12, a swingable squeeze plate 14 and a pressure piston 16 carrying a squeeze plate 18. The squeeze plate 18 carries a first pattern plate 6*a*, while the swingable squeeze plate carries a second pattern plate 6*b*.

The swingable squeeze plate 14 is moveable for opening the moulding chamber 12, as described further below.

The mould conveyor 20 comprises a moveable mould retainer 22 for gripping and moving the mould 2 or any single mould produced by the flaskless moulding machine 10. The mould conveyor 20 further comprises a stationary mould retainer 24 which can be actuated to clamp down and retain the last mould 2 in position.

In order to advance the mould string 4, the mould conveyor comprises a transport system exemplified by an AMC (Automatic Mould Conveyor) system illustrated by thrust bars 26, which clamps a plurality of moulds in the mould string 4 for advancing the mould string 4. During advancing, the moveable mould retainers 22 also assist by clamping and moving the last mould 2.

Also shown in FIG. 1A is a core setter 40 for setting core(s) 42 in a mould cavity produced by the last mould 2.

In the following Opr. is used as abbreviation for operation.

In FIG. 1A the mould producing procedure starts with Opr. 1, i.e. the sand is shot into the moulding chamber 12 while the moveable mould retainers 22, the stationary mould retainers 24 and the thrust bars 26 of the AMC system are active for engaging the last mould and the mould string 4, respectively. A pouring unit indicated by arrow 30 pours molten metal into one of the moulds in the mould string 4. The core setter 40 sets the core(s) 42.

Figure 1E:
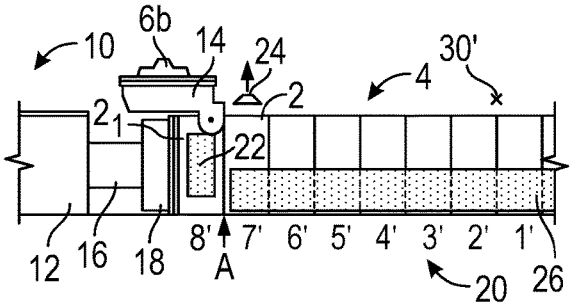
Figure 1B:
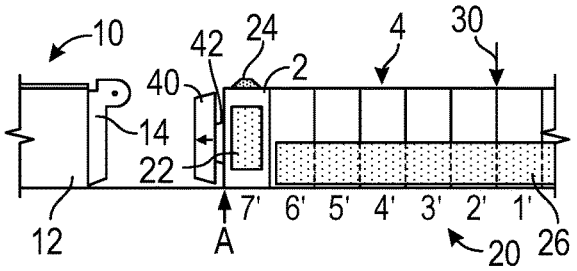
Figure 1F:
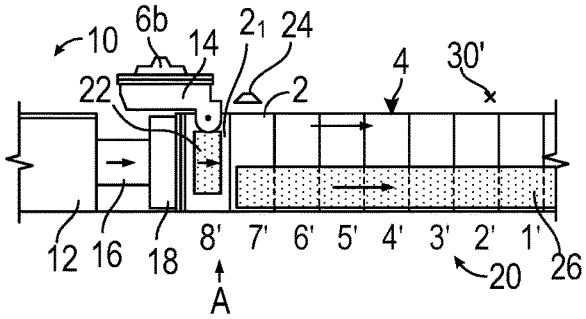
Figure 1C:
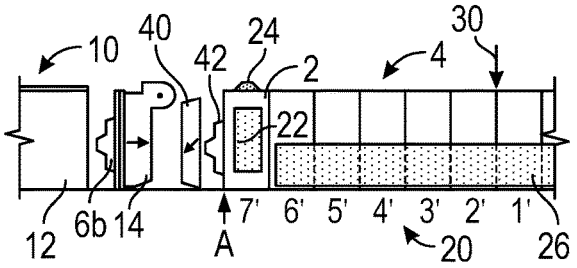
Figure 1G:
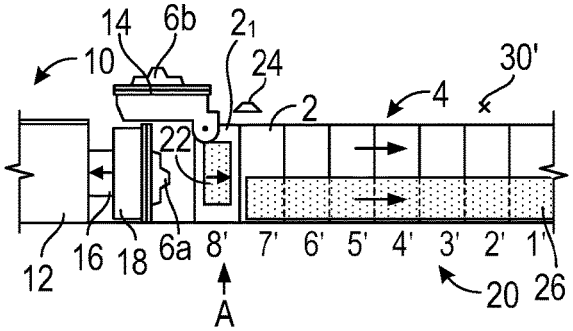
Figure 1D:
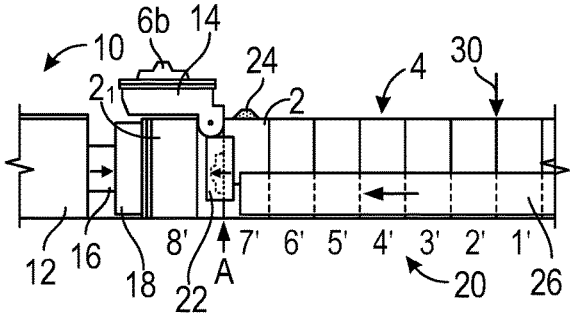

FIG. 1B shows Opr. 2, during which the pressure piston 16 is activated for squeezing the sand between the swingable squeeze plate 14 and the squeeze plate 18 to form a first mould $\mathbf{2}_1$ (shown first in FIG. 1D). The swingable squeeze plate 14 can also assist in squeezing the mould. The core setter 40 is starting to move away from the face of the mould 2 after having set the core(s) 42. The moveable mould retainers 22, the stationary mould retainers 24, and the thrust bars 26 of the AMC system remain active and the pouring of the molten metal continues.

Figure 2A:
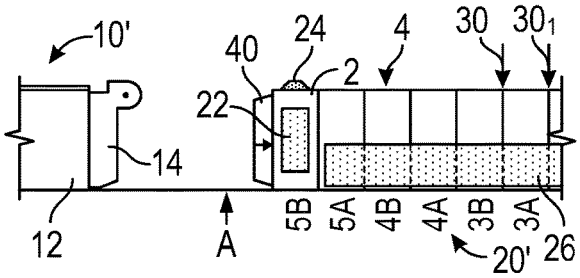
Figure 2E:
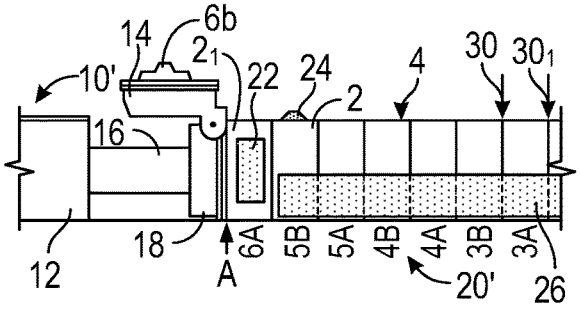
Figure 2B:
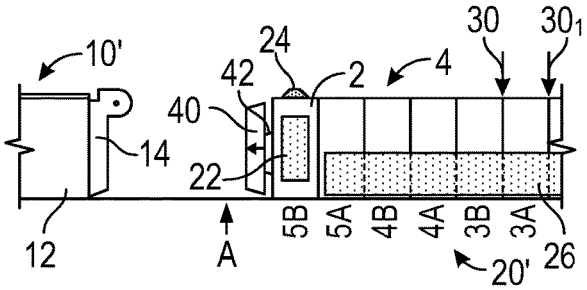
Figure 2F:
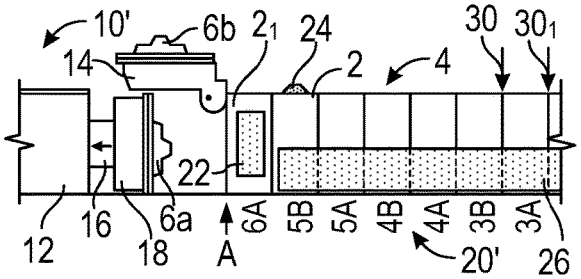
Figure 2C:
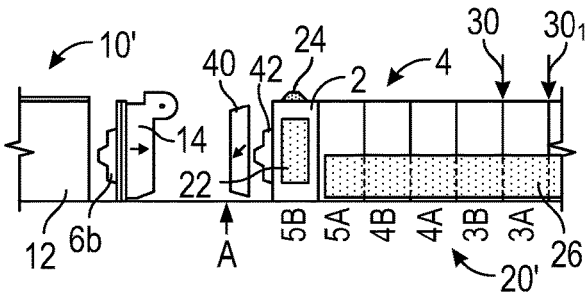
Figure 2G:
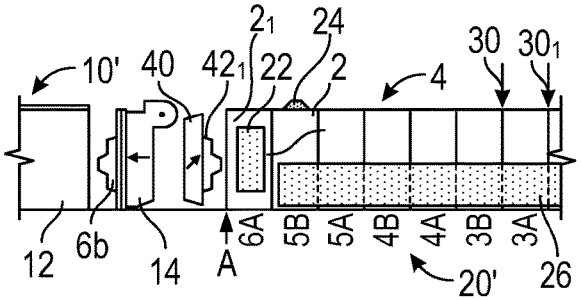
Figure 2D:
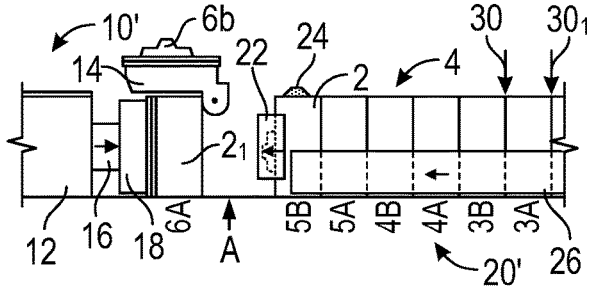

FIG. 1C shows Opr. 3, during which the swingable squeeze plate 14 starts to move away from the moulding chamber 12 so as to open the moulding chamber 12 for allowing the now produced first mould $\mathbf{2}_1$, shown in FIG. 2D, to be ejected from the moulding machine 10. The core setter 40 has cleared the last mould 2 and continues to move out of the way of the swingable squeeze plate 14. The moveable mould retainers 22, the stationary mould retainers 24, and the thrust bars 26 of the AMC system remain active, and the pouring of the molten metal continues.

FIG. 1D shows Opr. 4A short, during which the first mould $\mathbf{2}_1$, also designated 8, is ejected from the flaskless moulding machine 10 by being pushed by the pressure piston 16. At the same time the moveable mould retainers 22 release the last mould 2 and are transported the length of the last mould (2) towards the flaskless moulding machine 10. The thrust bars 26 of the AMC system have released the plurality of moulds of the mould string 4 and travel with the moveable mould retainers 22 towards the flaskless moulding machine 10. The stationary mould retaining device 24 remains active for holding the last mould 2 and thus the mould string 4 stationary. Pouring continues.

The moveable mould retainers 22 and the thrust bars 26 may be mechanically coupled to move together.

The first mould $\mathbf{2}_1$ is here to be delivered to the mould string 4 at a position below the swingable squeeze plate 14, i.e. the swingable squeeze plate 14 cannot swing down without hitting the first mould $\mathbf{2}_1$ when the first mould $\mathbf{2}_1$ is delivered to the mould string 4.

For the sake of clarity, the core setter 40, which is now outside the path of the first mould $\mathbf{2}_1$, is not shown in FIGS. 1D-1G.

In FIG. 1E Opr. 4A Short has been completed and the first mould $\mathbf{2}_1$ has been brought into contact with the last mould 2 by the pressure piston 16, and close up pressure between the first mould $\mathbf{2}_1$ and the mould string 4 has been built up. The moveable mould retainers 22 and the thrust bars 26 of the AMC system now engage the first mould $\mathbf{2}_1$ and the mould string 4, respectively. The stationary mould retainers 24 release the mould 2. After this is done, pouring has to stop as indicated by the cross designated 30' for being ready for the next step, transport of the mould string 4.

In FIG. 1F the pressure piston 16, after bringing the first mould $\mathbf{2}_1$ into contact with the mould string 4, assists the thrust bars 26 of the AMC system and the moveable mould retainers 22 in advancing the mould string 4 a first part of the distance of one mould thickness that the mould string 4 is to be advanced. The first part may for example correspond to bringing the mould string 4 in motion, i.e. for overcoming the static friction between the mould string and the mould conveyor 20 and/or for overcoming the inertia of the mould string 4 to accelerate it up to speed. Typically the first part of the distance is a small percentage of the full distance of one mould thickness that the mould string 4 is to be advanced before the pressure piston 16 reverses and allows the mould string to be advanced the second part of the distance, i.e. the remainder of the distance by the thrust bars 26 of the AMC system and by the moveable mould retainers 22 on their own.

The effect of the step shown in FIG. 1F is that the production rate is somewhat lowered due to the travel of the pressure piston increasing compared to the DISAMATIC® 2100 technique, however the AMC system with the thrust bars 26 and the moveable mould retainers 22 do not need to be as strong as is required when the thrust bars 26 and the moveable mould retainers 22 are responsible for advancing the mould string 4, which advancing includes overcoming static friction for bringing the mould string 4 in motion, accelerating the mould string to a suitable speed, i.e. overcoming dynamic friction and inertia, and advancing it the distance on its own. Hence the risk of getting gaps between the last moulds in the mould string 4 is significantly reduced.

In FIG. 1G Opr. 5 Short is performed wherein the pressure piston 16 has released the first mould $\mathbf{2}_1$ and is now retracting into the ready position for producing a new mould. The release is done on the "fly". The moveable mould retainers 22 and the thrust bars 26 of the AMC system now advance the mould string 4 the second part of the distance on their own without assistance from the pressure piston 16.

Figure 1H:
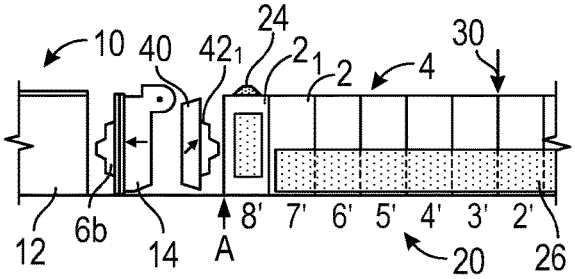

In FIG. 1H the swingable squeeze plate 14 is moving in to close the moulding chamber 12 while the core setter 40 is moving in to set the core(s) $\mathbf{42}_1$. The moveable mould retainers 22, the stationary mould retainers 24 and the thrust bars 26 of the AMC system remain active for engaging their respective moulds $\mathbf{2}_1$ and 2 and the mould string 4 while pouring has been restarted after the mould string 4 has stopped.

Following FIG. 1H the cycle will start over from FIG. 1A.

FIG. 2 shows a sequence of operations of the flaskless moulding machine 10', the mould conveyor 20', and the pouring unit 30 in a second embodiment of the method according to the first aspect of the present invention. Here the number of moulds is two, compared to being one in FIG. 1. The pouring unit here pours two moulds at the same time as illustrated by the arrow 30 and the additional arrow $\mathbf{30}_1$.

In FIG. 2A Opr. 1, is being performed. In this operation, sand (not shown) is shot into the moulding chamber 12, while the core setter 40 is setting core(s) 42 in the mould cavity. Further the moveable mould retainers 22 and the stationary mould retainers 24 are actively holding the last mould 2, and thereby the mould string 4, in position and preventing it from moving back. The thrust bars 26 of the AMC system are also active holding the mould string 4 in position. Molten metal is poured simultaneously into two mould cavities as indicated by the arrows 30 and $\mathbf{30}_1$.

FIG. 2B shows Opr. 2, during which the pressure piston 16 is activated for squeezing the sand between the swingable squeeze plate 14 and the squeeze plate 18 to form a first mould $\mathbf{2}_1$ (shown first in FIG. 2D). The swingable squeeze plate 14 can also assist in squeezing the mould. The core setter 40 is starting to move away from the face of the mould 2 after having set the core(s) 42. The moveable mould retainers 22, the stationary mould retainers 24, and the thrust bars 26 of the AMC system remain active and the pouring of the molten metal continues.

FIG. 2C shows Opr. 3, during which the swingable squeeze plate 14 starts to move away from the moulding chamber 12 so as to open the moulding chamber 12 for allowing the now produced first mould $\mathbf{2}_1$, shown in FIG. 2D, to be ejected from the moulding machine 10. The core setter 40 has cleared the last mould 2 and continues to move out of the way of the swingable squeeze plate 14. The moveable mould retainers 22, the stationary mould retainers 24, and the thrust bars 26 of the AMC system remain active, and the pouring of the molten metal continues.

FIG. 2D shows Opr. 4A Long, during which the first mould $\mathbf{2}_1$, also designated 6A, is ejected from the flaskless moulding machine 10 by being pushed by the pressure piston 16. At the same time the moveable mould retainers 22 release the last mould 2 and are transported the length of the last mould (2) towards the flaskless moulding machine 10. The thrust bars 26 of the AMC system have released the plurality of moulds of the mould string 4 and travel with the moveable mould retainers 22 towards the flaskless moulding machine 10. The stationary mould retaining device 24 remains active for holding the last mould 2, and thus the mould string 4, stationary. Pouring continues.

The moveable mould retainers 22 and the thrust bars 26 may be mechanically coupled to move together.

The first mould $\mathbf{2}_1$ is pushed by, e.g. under, the swingable squeeze plate 14. For the sake of clarity the core setter 40, which is now outside the path of the mould $\mathbf{2}_1$, is not shown in FIGS. 2D-F.

In FIG. 2E Opr. 4A Long is finished and the first mould $\mathbf{2}_1$ has been brought to a first delivery position, marked with the arrow designated A, and into contact with the last mould 2, i.e. the first mould $\mathbf{2}_1$ has been added to the mould string 4, by the pressure piston 16. The first delivery position A in FIG. 2E is positioned so that the swingable squeeze plate 14 can swing down without hitting the first mould $\mathbf{2}_1$. The moveable mould retainers 22 now engage the first mould $\mathbf{2}_1$ while the thrust bars 26 of the AMC system now engage a plurality of the moulds of the mould string 4 including the last mould 2. The stationary mould retainers 24 remain active for holding the last mould 2. Pouring continues.

FIG. 2F shows Opr. 5 Long, in which the pressure piston 16 is retracted into the flaskless moulding machine 10 into a ready position for forming the second mould $\mathbf{2}_2$. The moveable mould retainers 22 and the stationary mould retainers 24 continue gripping their respective moulds $\mathbf{2}_1$ and 2. The moveable mould retainers 22, by gripping the first mould $\mathbf{2}_1$, prevent that the first mould $\mathbf{2}_1$ is pulled away from the mould string 4 by the pressure piston 16 due to the friction between the first pattern plate 6*a* and the first mould $\mathbf{2}_1$ being larger than the friction between the first mould $\mathbf{2}_1$ and the mould conveyor 20. The thrust bars 26 of the AMC system remain active, and pouring continues.

In FIG. 2G, corresponding to Opr. 6, the swingable squeeze plate 14 swings down and moves in to close the moulding chamber again while the core setter 40 approaches the first mould $\mathbf{2}_1$ for setting the new core(s) $\mathbf{42}_1$ in its mould cavity. The moveable mould retainers 22, the stationary mould retainers 24 and the thrust bars 26 of the AMC system remain active for engaging their respective moulds $\mathbf{2}_1$ and 2 and the mould string 4 while pouring continues.

Figure 2H:
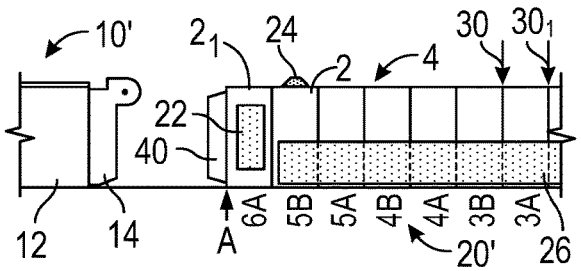

In FIG. 2H the mould producing procedure starts over with Opr. 1, i.e. the sand is shot into the moulding chamber 12 while the moveable mould retainers 22, the stationary mould retainers 24 and the thrust bars 26 of the AMC system remain active for engaging their respective moulds $\mathbf{2}_1$ and 2 and the mould string 4 while pouring continues. The core setter 40 sets the core(s) $\mathbf{42}_1$.

Figure 2I:
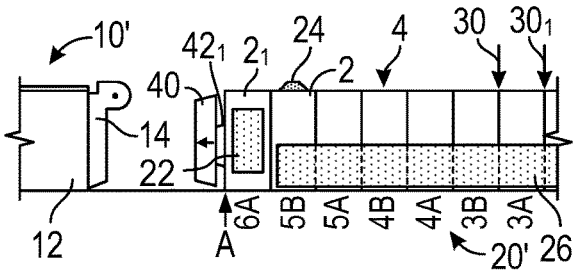

In FIG. 2I Opr. 2 is repeated for forming a second mould $\mathbf{2}_2$ as described above with reference to FIG. 2B. The moveable mould retainers 22, the stationary mould retainers 24 and the thrust bars 26 of the AMC system remain active for engaging their respective moulds $\mathbf{2}_1$ and 2 and the mould string 4 while pouring continues. The core setter 40 is starting to move away from the face of the mould 2 after having set the core(s) $\mathbf{42}_1$.

Figure 2L:
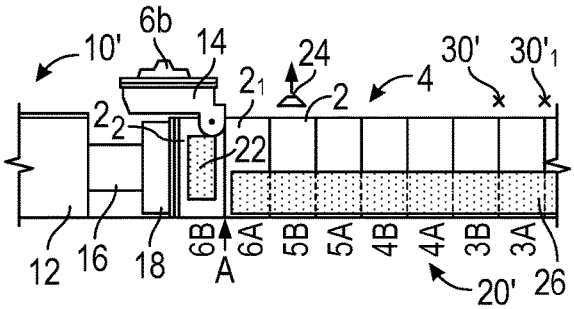
Figure 2J:
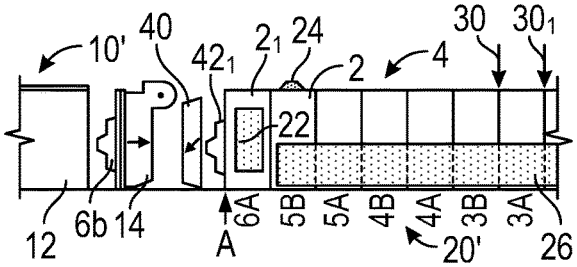

In FIG. 2J Opr. 3 is repeated as described above with reference to FIG. 2C. The moveable mould retainers 22, the stationary mould retainers 24 and the thrust bars 26 of the AMC system remain active for engaging their respective moulds $\mathbf{2}_1$ and 2 and the mould string 4 while pouring continues. The core setter 40 has cleared the first mould $\mathbf{2}_1$ and continues to move out of the way of the swingable squeeze plate 14.

Figure 2M:
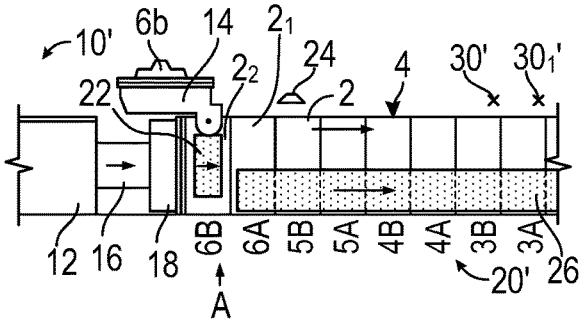
Figure 2K:
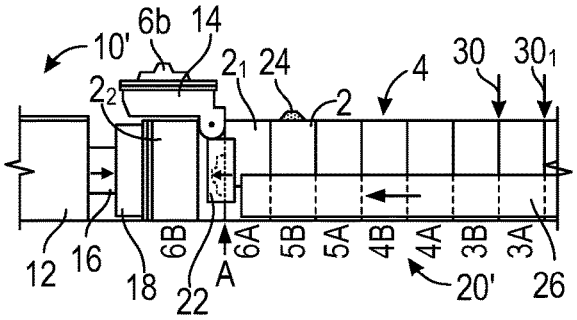

In FIG. 2K Opr. 4A Short is performed. This operation differs from operation 4A Long described above with reference to FIG. 1D in that the second mould $\mathbf{2}_2$ is to be deposited at a second delivery position one mould thickness closer to the flaskless moulding machine 10 than the first delivery position A. This second delivery position is below the swingable squeeze plate 14, i.e. the swingable squeeze plate 14 cannot swing down without hitting the second mould $\mathbf{2}_2$ when the second mould $\mathbf{2}_2$ is in the second delivery position.

As with Opr. 4A Long, the moveable mould retainers 22 release the mould $\mathbf{2}_1$ and move one mould thickness closer to the flaskless moulding machine 10 for gripping the second mould $\mathbf{2}_2$. The thrust bars 26 of the AMC system release the mould string 4 and also follow the moveable mould retainers 22 towards the flaskless moulding machine 10. The stationary retaining device 24 remains active for holding the last mould 2 and the mould string 4 stationary. Pouring continues.

For the sake of clarity, the core setter 40, which is now outside the path of the mould $\mathbf{2}_2$, is not shown in FIGS. 2K-N.

In FIG. 2L Opr. 4A Short has been completed and the second mould $\mathbf{2}_2$ has been brought to the second delivery position and into contact with the mould $\mathbf{2}_1$ by the pressure piston 16, and close up pressure between the second mould $\mathbf{2}_2$ and the mould string 4 has been built up. The moveable mould retainers 22 and the thrust bars 26 of the AMC system now engage the second mould $\mathbf{2}_2$ and the mould string 4, respectively. The stationary mould retainers 24 release the mould 2. After this is done, pouring has to stop as indicated by the crosses designated 30' and $\mathbf{30'}_1$ for being ready for the next step, transport of the mould string 4.

FIG. 2M corresponds to FIG. 1F, the difference being that the mould string 4 is now to be advanced the distance of two mould thicknesses, in contrast to one mould thickness in FIG. 1F. Thus in FIG. 2M the pressure piston 16, after bringing the second mould $\mathbf{2}_2$ into contact with the mould string 4, assists the thrust bars 26 of the AMC system and the moveable mould retainers 22 in advancing the mould string 4 a first part of the distance of two mould thicknesses that the mould string 4 is to be advanced. In the second embodiment shown in FIG. 2 the first part of the distance is typically the same or similar absolute distance, however, due to the distance that the mould string 4 is to be advanced now being doubled, the first part will be a smaller proportion of the total distance that the mould string 4 is to be advanced.

Figure 2N:
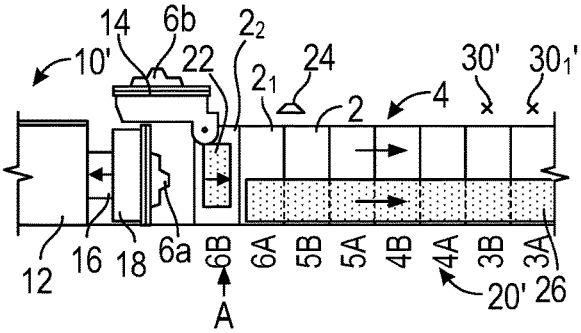

In FIG. 2N Opr. 5 Short is performed which differs from Opr 5 Long shown in FIG. 2F in that, as the pressure piston 16 is retracted towards the ready position, as in FIG. 1F, the moveable mould retainers 22 and the thrust bars 26 of the AMC system advance the mould string 4 on their own by gripping and advancing the second mould $\mathbf{2}_2$ as well as the mould string 4 the second part of the distance corresponding to two mould thicknesses. This movement of the mould string 4 is continued in FIG. 2O. Furthermore, Opr. 5 Short differs from Opr. 5 Long in that the pressure piston 16 has to travel a shorter distance to get back into the moulding chamber 12.

The overlap between the swingable squeeze plate 14, the second mould $\mathbf{2}_2$, and the pressure piston 16 depends on the speed of the swingable squeeze plate 14, the speed of the second mould $\mathbf{2}_2$, i.e. the speed of the mould string 4, the thicknesses of the moulds 2, $\mathbf{2}_1$, $\mathbf{2}_2$, and the speed of the pressure piston 16. As the thickness of the moulds increases, longer transport times are needed.

Figure 2O:
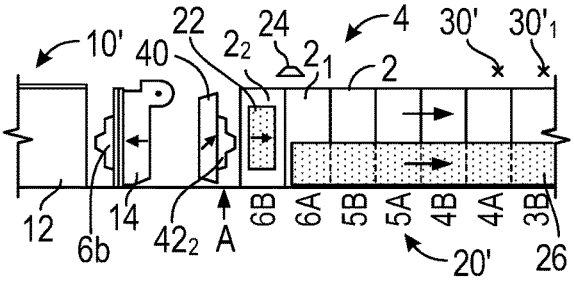

FIG. 2O shows a modified Opr. 6, in which the swingable squeeze plate 14 starts to move in to close the moulding chamber 12, and the core setter 40 starts to move in to set the core(s) $\mathbf{42}_2$ in the second mould $\mathbf{2}_2$. In FIG. 2O the movable mould retainers 22 and the thrust bars 26 of the AMC system still have to advance the mould string 4 the distance of about half of a mould thickness before the stationary mould retainers 24 may engage the second mould $\mathbf{2}_2$ and the procedure is repeated from FIG. 2A. The difference from the standard opr. 6 is that the mould string 4 is advanced during the modified opr. 6.

During the operations shown in FIGS. 2L to 2O pouring is stopped; however pouring may be started again as soon as the movement of the mould string 4 is finished as shown in FIG. 2A.

The AMC system represented by the thrust bars 26 may be supplanted by, or combined with a PMC (Precision Mould Conveyor) system, and/or a SBC (Synchronized Belt Conveyor) system, or any other suitable transport system.

As is clear from FIG. 2 a very long available pouring time is achieved. At the same time the time for forming the first and second moulds $\mathbf{2}_1$ and $\mathbf{2}_2$ is kept short.

Additionally, as the mould string 4 is stationary when forming and ejecting the second mould $\mathbf{2}_2$, this second mould $\mathbf{2}_2$ does not have to be brought to the first delivery position A, rather it is only brought to the second delivery position, which is closer to the flaskless moulding machine 10, thereby further decreasing the total travel of the pressure piston 16. This applies to every other second mould produced.

As the double cycle has been finished, the process starts over, the second mould ($\mathbf{2}_2$) now being the last mould 2 on FIG. 2A and the cores $\mathbf{42}_2$ being 42 shown in FIG. 1B.

FIG. 3 shows a sequence of operations of the flaskless moulding machine 10", the mould conveyor 20", and the pouring unit 30 in a third embodiment of the method according to the first aspect of the present invention. Here again the number of moulds is two.

Figure 3A:
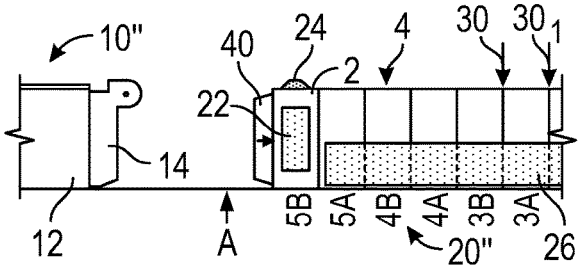
Figure 3E:
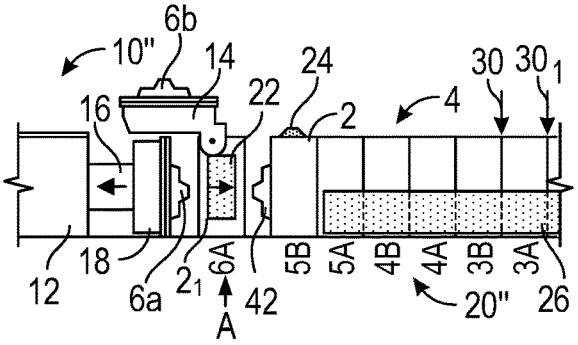
Figure 3B:
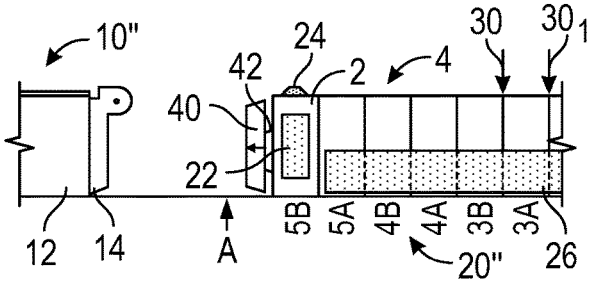
Figure 3F:
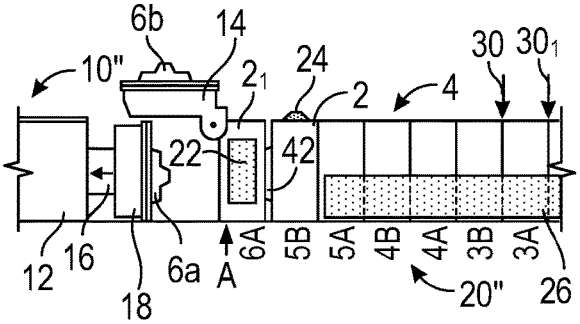
Figure 3C:
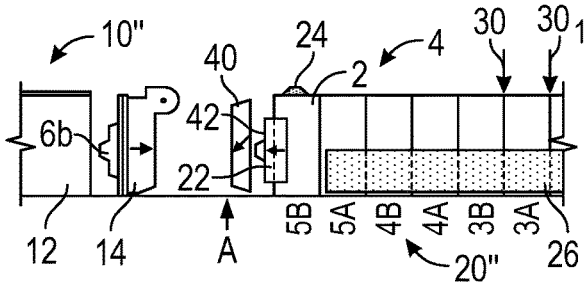
Figure 3G:
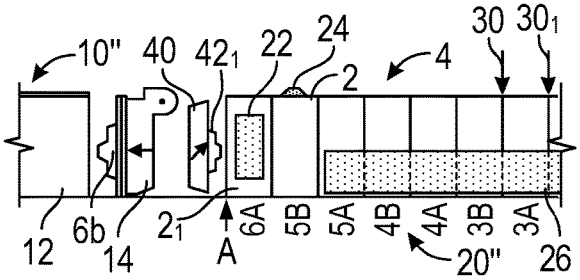

The third embodiment differs from the second embodiment as follows:

In FIG. 3C a modified Opr. 3 is performed. This operation differs from the Opr. 3 shown in FIG. 2C in that the moveable mould retainers 22 already now start to move towards the flaskless mould machine while the thrust bars 26 of the AMC system remain active. Here the moveable mould retainers 22 and the thrust bars 26 can move in relation to each other. The stationary mould retainers 24 remain active and pouring continues.

Figure 3D:
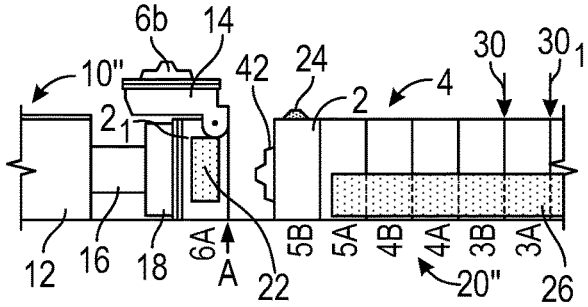

In FIG. 3D Opr. 4A Short has been performed. Thus, instead of bringing the first mould $\mathbf{2}_1$ to the first delivery position A, as in FIG. 2D, the pressure piston 16 has only brought the first mould $\mathbf{2}_1$ to a first intermediate position in which the first mould $\mathbf{2}_1$ is spaced apart from the mould string 4. As the first mould $\mathbf{2}_1$ is brought to the first intermediate position, the moveable mould retainers 22 reach the first mould $\mathbf{2}_1$ and engage the first mould $\mathbf{2}_1$ by gripping the first mould $\mathbf{2}_1$.

As can be seen in FIG. 3D, the first intermediate position is positioned below the swingable squeeze plate 14.

In FIG. 3E a modified version of Opr. 5 Short is performed, whereby the pressure piston 16 is retracted towards the ready position and the first mould $\mathbf{2}_1$ is brought into contact with the mould 2 by being gripped and moved towards the mould string 4 by the moveable mould retainers 22.

FIG. 3F shows the first mould $\mathbf{2}_1$ just prior to being brought into contact with the mould string 4.

Figure 3H:
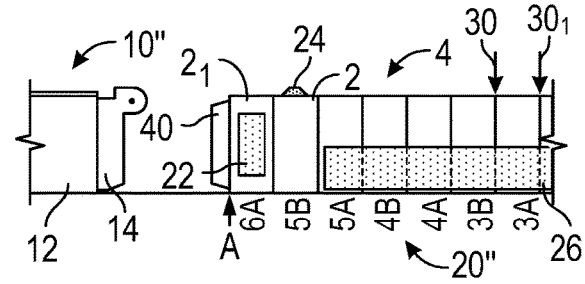
Figure 3I:
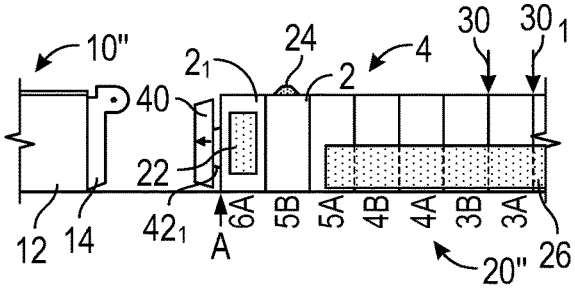
Figure 3L:
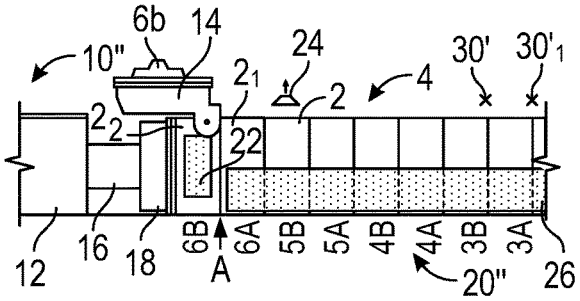
Figure 3J:
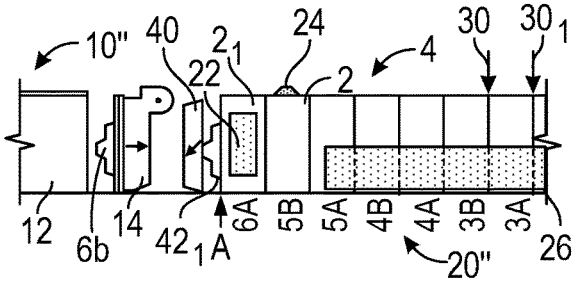
Figure 3M:
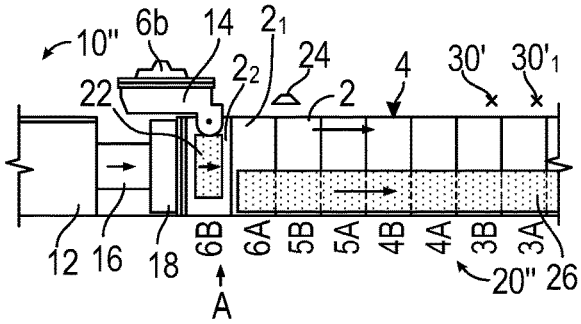
Figure 3K:
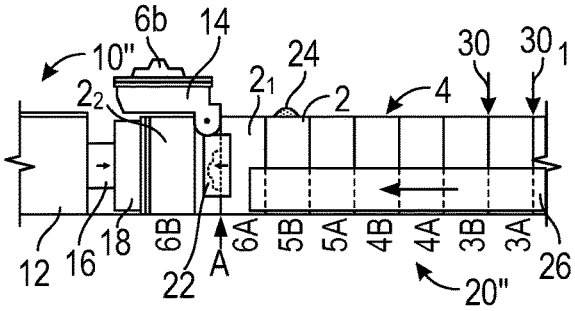
Figure 3N:
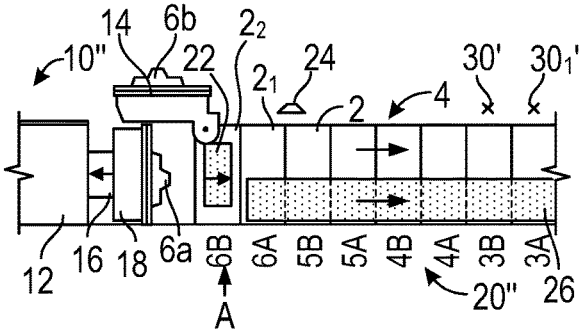
Figure 3O:
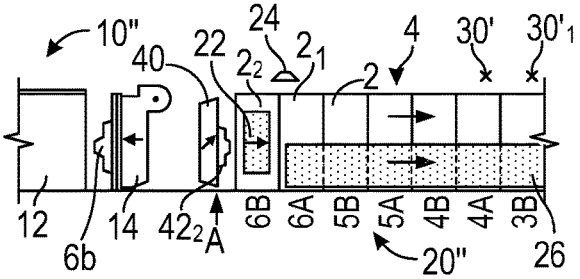

In FIG. 3K a modified version of the operation shown in FIG. 2K is shown. In this modified version the thrust bars 26 of the AMC system release and move two mould thicknesses closer to the flaskless moulding machine 10 while the movable mould retainers 22 also release and move one mould thickness closer to the flaskless moulding machine 10, i.e. the thrust bars 26 of the AMC system move at a higher speed, indicated with a longer arrow, than the moveable mould retainers 22 so that the movable mould retainers 22 and the thrust bars 26 of the AMC system end up at their end positions at the same time.

The rest of the sequence is the same as in the second embodiment.

This third embodiment of the method has the advantage that the travel of the pressure piston 16 is further reduced because it only brings the first mould $\mathbf{2}_1$ to the first intermediate position, i.e. Opr 4A is short in each of the cycles in the double cycle of the flaskless moulding machine 10" and the mould conveyor 20.

As the double cycle has been finished, the process starts over, the second mould ($\mathbf{2}_2$) now being the last mould 2 on FIG. 3A and cores $\mathbf{42}_2$ being 42 on FIG. 3B.

In FIG. 3, cores 42, $\mathbf{42}_1$ and $\mathbf{42}_2$ are set by the core setter 40 in two different positions along the mould conveyor 20 as shown on FIGS. 3A and 3H.

For the sake of clarity, the core setter 40 is not shown in FIGS. 3D-F and 3K-M In the FIGS. 2-3, two moulds are produced and added to the mould string 4, whereafter the mould string 4 is advanced a distance corresponding to two mould thicknesses. The method according to the first aspect of the present invention may however also be used for producing more than two moulds and advancing the mould string 4 a distance corresponding to the sum of thicknesses of the more than two moulds.

LIST OF PARTS WITH REFERENCE TO THE FIGURES

A. Arrow indicating first delivery position
2. Last mould
$\mathbf{2}_1$. First mould
$\mathbf{2}_2$. Second mould
4. Mould string
6*a*. First pattern plate
6*b*. Second pattern plate
10. Flaskless moulding machine
12. Moulding chamber
14. Swingable squeeze plate
16. Pressure piston
18. Squeeze plate
20. Mould conveyor
22. Movable mould retainers
24. Stationary mould retainers
26. Thrust bars of AMC system
30. Arrow indicating pouring into one mould
$\mathbf{30}_1$. Arrow indicating pouring into another mould
30'. Cross indicating non-pouring into one mould
$\mathbf{30'}_1$. Cross indicating non-pouring into another mould
40. Core setter
42. Cores
$\mathbf{42}_1$. Cores
$\mathbf{42}_2$. Cores

The invention claimed is:

1. A method of indexing moulds using a flaskless moulding machine for producing moulds and a mould conveyor for carrying and advancing a mould string produced from a plurality of said moulds received by the mould conveyor from said flaskless moulding machine, said flaskless moulding machine comprising a pressure piston, the method comprising the steps of:

i. forming one or more moulds, one at a time, using said flaskless moulding machine, each of said one or more moulds being added to said mould string while said mould string is stationary, by being brought into contact with said mould string subsequently to being produced by said flaskless moulding machine, and, once said one or more moulds have been produced and added to said mould string:

ii. advancing said mould string, in a single motion, away from said flaskless moulding machine a distance corresponding to the sum of the thicknesses of said one or more moulds using said mould conveyor, wherein said flaskless moulding machine assists said mould conveyor in overcoming the static friction for bringing said mould string in motion by assisting the mould conveyor in advancing said mould string for a first part of the distance, the first part being up to 50 percent of the distance, said mould conveyor advances said mould string a second part of said distance, corresponding to the remainder of said distance, without assistance from said flaskless moulding machine, and said pressure piston is retracted for producing one or more further moulds once said mould string has been advanced said first part of said distance so that the pressure piston only travels the first part of said distance, and not the full distance.

2. The method according to claim 1, said flaskless moulding machine further assisting said mould conveyor in accelerating said mould string to a desired speed.

3. The method according to claim 2, said flaskless moulding machine further assisting said mould conveyor in advancing said mould string to a position from which said mould string is to be decelerated for being stationary once said mould string has been advanced said distance.

4. The method according to claim 1, wherein said one or more moulds are added to said mould string by said flaskless moulding machine.

5. The method according to claim 1, wherein at least a last one of said one or more moulds is added to said mould string by said flaskless moulding machine and wherein the remainder of said one or more moulds are added to said mould string by first being moved by said flaskless moulding machine to an intermediate position between said flaskless moulding machine and the mould string, and then by being moved from said intermediate position into contact with said mould string by said mould conveyor.

6. The method according to claim 1, further comprising using a core setter capable of setting cores in one or more positions along the mould string for setting a core in a mould cavity of each of said one or more moulds after each of said one or more moulds has been added to said mould string.

7. The method according to claim 5, each of said remainder of said one or more moulds, while being moved from said intermediate position, being moved to a core setting position by said mould conveyor, the method further comprising using a core setter capable of setting cores at said core setting position for setting a core in a mould cavity of each of said remainder of said one or more moulds while each of said remainder of said one or more moulds is at said core setting position, before each of said remainder of said one or more moulds is moved into contact with said mould string by said mould conveyor.

8. The method according to claim 1, said mould conveyor comprising moveable mould retainers for engaging and moving a single mould of said one or more moulds, and a transport system for engaging and moving a second plurality of moulds in said mould string, for advancing said mould string said distance.

9. The method according to claim 1, said mould conveyor further comprising stationary mould retainers for selectively keeping said mould string stationary by engaging a last mould of said mould string, the method further comprising the steps of:

engaging said last mould while performing step i, and releasing said last mould prior to performing step ii.

10. The method according to claim 2, wherein said one or more moulds are added to said mould string by said flaskless moulding machine.

11. The method according to claim 3, wherein said one or more moulds are added to said mould string by said flaskless moulding machine.

* * * * *